US005225788A

United States Patent [19]

Norris et al.

[11] Patent Number: 5,225,788

[45] Date of Patent: Jul. 6, 1993

[54] SINGLE-BUNCH SYNCHROTRON SHUTTER

[75] Inventors: James R. Norris, Downers Grove; Jau-Huei Tang; Lin Chen, both of Naperville; Marion Thurnauer, Downers Grove, all of Ill.

[73] Assignee: The United States of America as represented by the United States Department of Energy, Washington, D.C.

[21] Appl. No.: 762,966

[22] Filed: Sep. 20, 1991

[51] Int. Cl.[5] ..... H05H 7/08

[52] U.S. Cl. ..... 328/235

[58] Field of Search ..... 328/233, 235; 313/62

[56] References Cited

U.S. PATENT DOCUMENTS 4,992,745 2/1991 Hiyota et al. ..... 328/235

*Primary Examiner*—Sandra L. O'Shea

*Attorney, Agent, or Firm*—Mark P. Dvorscak; Robert J. Fisher; William R. Moser

[57] ABSTRACT

An apparatus for selecting a single synchrotron pulse from the millions of pulses provided per second from a synchrotron source includes a rotating spindle located in the path of the synchrotron pulses. The spindle has multiple faces of a highly reflective surface, and having a frequency of rotation f. A shutter is spaced from the spindle by a radius r, and has an open position and a closed position. The pulses from the synchrotron are reflected off the spindle to the shutter such that the speed s of the pulses at the shutter is governed by:

$$s=4\times\pi\times r\times f.$$

such that a single pulse is selected for transmission through an open position of the shutter.

5 Claims, 6 Drawing Sheets

SINGLE-BUNCH SYNCHROTRON SHUTTER

CONTRACTUAL ORIGIN OF THE INVENTION

The United States Government has rights in this invention pursuant to Contract No. W-31-109-ENG-38 between the U.S. Department of Energy and the University of Chicago.

BACKGROUND OF THE INVENTION

This invention relates generally to a synchrotron shutter and more particularly to a synchrotron shutter in which a rotating multifaced mirror is spaced from a slit in appropriate distance and has a timed rotation such that only selected synchrotron pulses reflected off the mirror are directed through the slit.

Subatomic particles such as electrons, positrons, and protons, can be accelerated to high velocities and energies, usually expressed in terms of center-of-mass energy, by machines which impart energy to the particles in small stages or nudges, ultimately achieving in this way very high-energy beams. In a synchrotron, the particles are made to follow a circular or closed curve by arranging a number of magnets in a ring. Groups of particles may circle a ring of this kind several million times while they are increasing their energy and velocity. Ultimately, these accelerated particles are extracted and then directed to strike a fixed target.

Synchrotron radiation is the electromagnetic radiation emitted as a result of continual acceleration toward the axis of rotation of charged particles moving in a magnetic field. It is a source of tunable coherent x-rays, and is used for phase- and element-sensitive microprobing of biological assemblies and material interfaces as well as research on the production of electronic microstructures with features smaller than 1000 angstroms.

Typically, synchrotrons provide millions of intense light pulses per second. In studying changing structures of complex crystals, the experimentalist can, at best, irradiate samples with a minimum of several hundred pulses. In contrast to conventional synchrotron experiments, the key to performing time-domain research is the ability to select a single pulse from the millions provided. The timing of the selection may also be dependent on the timed exposure of the crystal to a laser pulse or other energy to induce structural and/or chemical change. One solution is to use a rotating slit for the selection. However, at the excessive speed of the pulsed beam, the slit rotation would be difficult to achieve with the desired speed and accuracy. No existing synchrotron facility can conduct such single-bunch experiments.

One of the most challenging problems in natural artificial photosynthesis research is the direct detection of structural changes accompanying photophysical and photochemical reactions, especially those with very fast reaction rates. In these cases, conventional steady-state X-ray diffraction, small-angle scattering, and X-ray absorption techniques have very little chance of success. However, synchrotron radiation, a source of intense pulsed X-rays, provides the potential to monitor fast structural changes via time-resolved X-ray spectroscopies and diffraction. The synchrotron source, with an ultimate time resolution of less than 50 ps, has the great potential of detecting structural changes occurring on a comparable time scale.

Accordingly, it is an object of the present invention to control the repetition rate of synchrotron pulses.

Another object of the present invention is to select a single pulse or bunch from a large number of pulses in an x-ray beam on which to direct a crystal.

A further object of the present invention is to provide a mechanism for the study of:

1) time-domain structure determination using EXAFS (Extended X-ray Absorption Fine Structure) and XANES (X-ray Absorption Near Edge Structure);

2) time-resolved crystallography; and,

3) X-ray radiation-damage studies.

SUMMARY OF THE INVENTION

This invention provides an apparatus for selecting a single synchrotron pulse from the millions of pulses provided per second from a synchrotron source which comprises a rotatable spindle placed in the path of the synchrotron pulses. The spindle has multiple faces of a highly reflective surface, and a frequency of rotation f. A shutter is spaced from the spindle by a radius r, at a location to receive pulses reflected from the spindle. The shutter includes a gap of substantially less width than the spacing between the spindle and the shutter. The spacing of the shutter from the spindle, the rotational speed of the spindle, and the width of the gap in the shutter are all selected so that the reflected light off the spindle moves at a speed to transmit only a single pulse of radiation through the gap in the shutter to a sample placed behind the shutter. In operation, the spindle has a frequency of rotation f, the shutter is spaced from the spindle by a radius r, and the speed s of the pulses arriving at the shutter is governed by:

$$s=4\times\pi\times r\times f$$

whereby a single pulse is selected for transmission through the slit in the shutter. The rotational frequency of the spindle is slaved to the frequency of the synchrotron pulse frequency. Preferably, the spindle has eight faces, each having a mirrored surface.

In another embodiment of the invention, a synchrotron shutter is provided which comprises a synchrotron emitting light pulses having a frequency providing a multiplicity of intense light pulses per second. A mirrored spindle is located in the path of the light pulses and has a rotational frequency slaved to the synchrotron pulse frequency. A shutter is spaced from the synchrotron and the mirrored spindle. In this manner, light pulses from the synchrotron are reflected off the spindle to the shutter such that a single pulse is selected for transmission through the shutter for probing of a sample placed behind the shutter. A laser can be synchronized with the synchrotron pulses, the laser providing intense pulses to create in the sample an excited state from a relaxed ground state, such that the single synchrotron pulse transmitted through the shutter to the sample examines the sample in its excited state. The time that the reflected synchrotron pulse spends in transmitting to the shutter is provided by:

$$\frac{1}{4\times\pi\times r\times f}$$

where r is the radius from the center of the spindle to the shutter, and f is the frequency of the rotation of the spindle.

BRIEF DESCRIPTION OF THE DRAWINGS

The above-mentioned and other features of the invention will become more apparent and be best understood, together with the description, by reference to the accompanying drawings, in which.

DETAILED DESCRIPTION OF THE INVENTION

Figure 1:
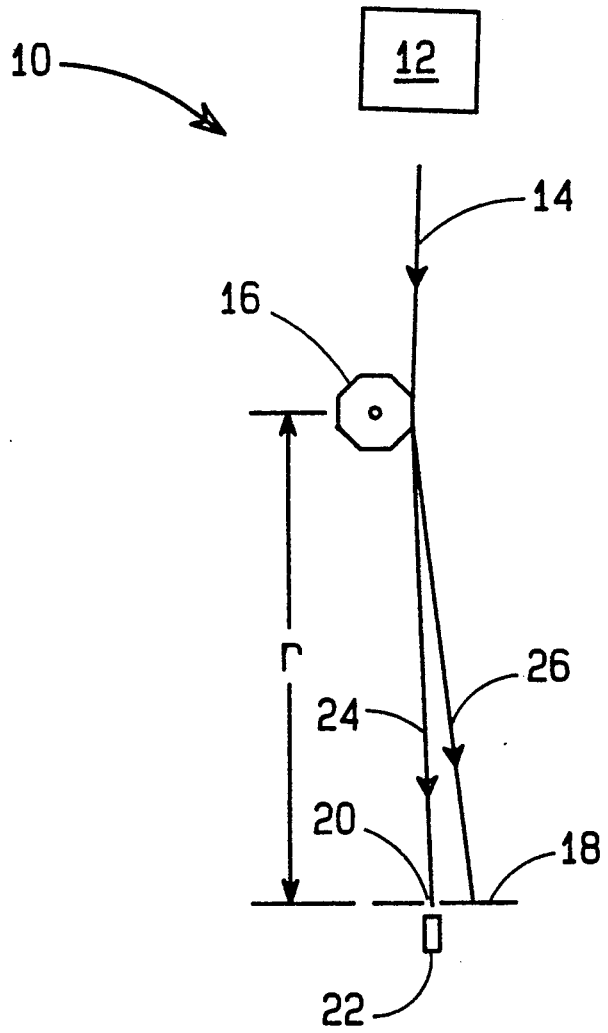
FIG. 1 shows a schematic diagram of a synchrotron shutter in accordance with the present invention.

FIG. 1 shows a schematic diagram of a single-bunch synchrotron shutter 10 in accordance with the present invention. A synchrotron 12 provides a source of intense, pulsed x-rays 14. The x-ray pulses emitted by the synchrotron have a frequency providing a multiplicity of intense light pulses per second. A rotatable, mirrored spindle 16 is located in the path of the synchrotron light pulses. The spindle includes a rotor (not shown) commercially available as a component of an infrared scanner manufactured by Speedring. The spindle has a rotational frequency that is slaved to the synchrotron pulse frequency. A shutter 13 is spaced from the mirrored spindle 16, at a location to receive pulses reflected from the spindle. Shutter 18 includes a narrow gap or slit 20 having a variable width of substantially less than the spacing between the spindle and the shutter. The shutter is a standard component used in current x-ray spectroscopy. The synchrotronlight pulses 14 are reflected off the spindle to the shutter 18, behind which is placed a sample 22 to be examined. The spacing of the shutter from the spindle, the rotational speed of the spindle, and the width of the gap in the shutter are all selected so that the reflected light off the spindle moves at a speed to transmit only a single pulse of radiation through the gap in the shutter to the sample. In operation, the spindle has a frequency of rotation f, the shutter is spaced from the spindle by a radius r, and the speed s of the pulses arriving at the shutter is given by:

$$S=4\times\pi\times r\times f. \quad (3)$$

In a preferred embodiment, the spindle is eight-sided. A small spindle rotating at a low f of about 7,500 rpm (125 Hz) is sufficient to select a single synchrotron pulse. The radius r from the spindle 16 to the slit is about 2 meters, while the slit width 20 is about 0.5 mm. As long as the reflected light at a distance of two meters moves across the slit 20 faster than 0.5 mm in 354 ns, only a single bunch of radiation will enter the slit per mirror face. The result is a reflected pulse 24 at the shutter going four times faster than the speed of sound while the rotating spindle 16 is moving significantly slower than the speed of sound. This technique solves the speed requirement for the shutter. The light pulses from the synchrotron are reflected off the spindle to the shutter 18 such that the single pulse 24 is selected for transmission through the shutter 18 for probing or examination of the sample 22 placed behind the shutter. Pulse 26 is rejected for transmission through the shutter.

The above approach introduces the new technical problem of spatial stability. By one approach, high stability can be achieved by making the spindle 16 with a sufficiently large moment of inertia such that rotational speed is ultra-stable. However, the moment of inertia should not be too large to be unresponsive to speed change by the feedback system. A feedback electronics for the rotor limits its phase jitter to about a few nanoseconds. In another approach, a two-sided mirror can be used. This would prevent the required planarity of the x-ray mirror from being distorted by forces created by rotation of the mirror assembly.

Figure 5:
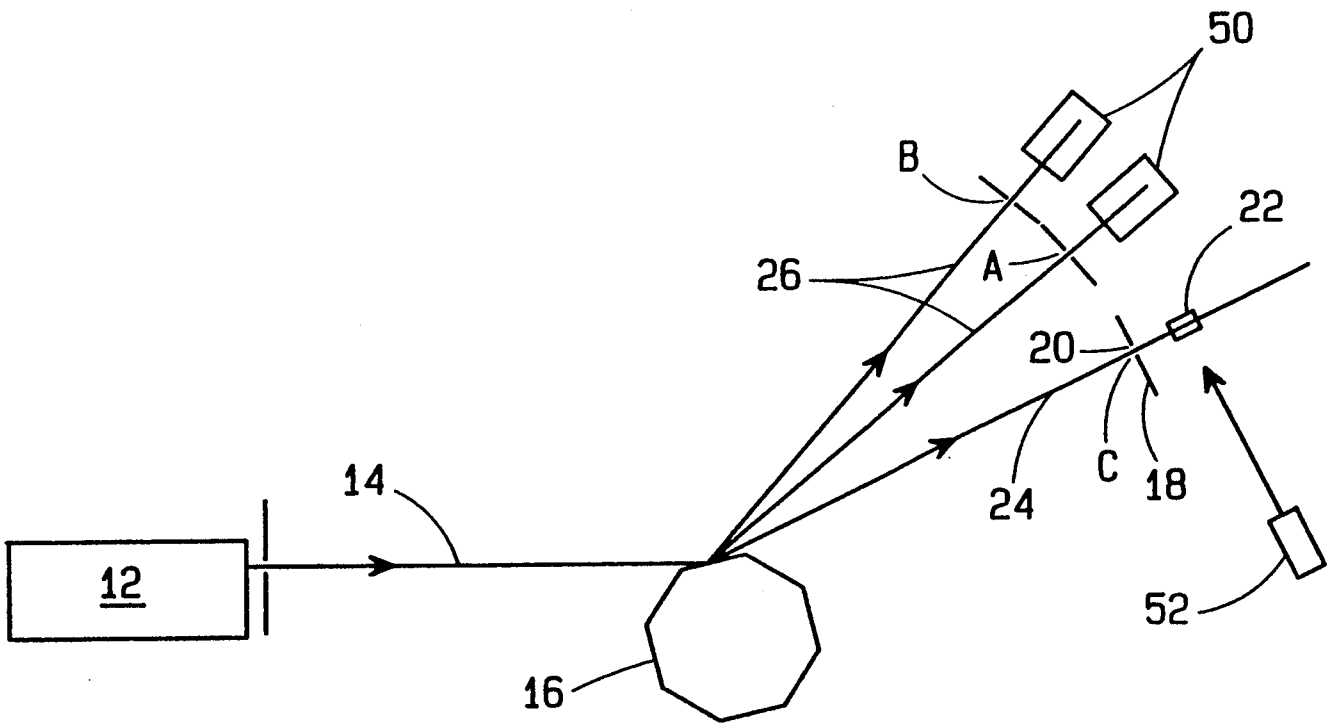
FIG. 5 shows an embodiment of the invention employing a laser to ensure that a reflected radiation bunch strikes a slit with a desired accuracy; and, FIG. 6 shows another arrangement for achieving desired accuracy shown by FIG. 5.

The reflected-radiation bunch 24 must strike the 0.5 mm slit 20 within ±0.05 mm accuracy. Since the total circumference is $2x\pi xr$, an accuracy of ±1 part in 125,000 is required for a radius of two meters. This accuracy can be achieved by two approaches, one of which is shown by FIG. 5. Two x-ray detectors 50 are used to detect the timing and the phase of the x-ray pulses 14 emitted from the synchrotron 12. The output from the x-ray detectors is fed to feedback electronics (not shown) to synchronize the rotor speed of the spindle 16 so that a selected full x-ray pulse will be able to pass the shutter 18 and irradiate the sample placed behind the slit. The width of the slits A and B for the detectors 50 are chosen to be the same as the x-ray beam size so that the slits are merely wide enough for the pass of a single x-ray beam bunch. A laser 52 slaved to the synchrotron source is then pulsed for optical excitation once the selected x-ray bunch is allowed to pass the shutter 18 in the time-resolved experiments. The distance between slits A and B is set at an appropriate distance so that at most only one x-ray bunch can pass either slits A or B. With these arrangements the time at which an x-ray pulse occurs can be measured accurately. The distance between A and C is chosen such that when a full pulse passes slit A another pulse can pass slit C.

Figure 6:
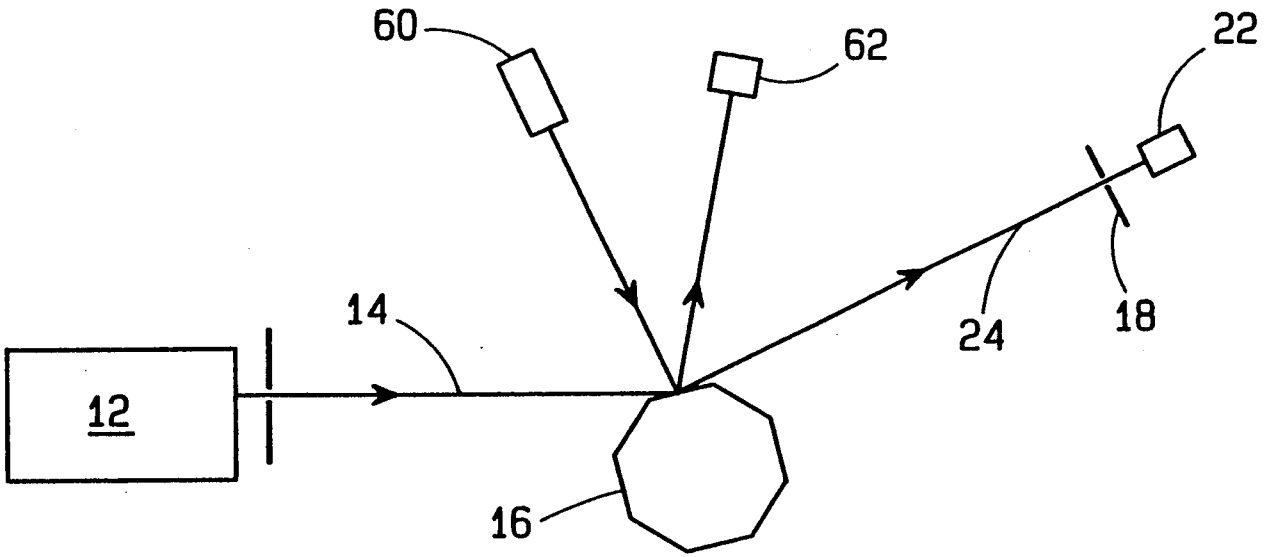

Another approach for achieving the desired accuracy is shown in FIG. 6. An alignment laser 60 and a photodetector 62 replace the two x-ray detectors 50 and the slits A and B. The output from the photodetector 62 and the logic pulse from the synchrotron source as the reference are used as the input for the spindle rotor controller. Similar devices have been used to measure the speed of light.

The disclosed invention solves the main difficulty of controlling the repetition rate of the synchrotron pulses by providing a "shutter" for x-rays that singles out a particular x-ray bunch provided in the train of synchrotron pulses. Time-domain experiments require the selection of a single bunch of x-rays on demand to serve as either an analyzing "probe pulse" or as an excitation "pump pulse" for investigating dynamics in chemical systems requiring picosecond resolution. With the disclosed invention the exploration of the following three major topics is possible: 1) time-domain structure determination using EXAFS (Extended X-ray Absorption Fine Structure) and XANES (X-ray Absorption Near Edge Structure); 2) time-resolved crystallography; 3) X-ray radiation-damage studies.

Lasers with pulse widths less than 1 ps are employed both to examine and to initiate chemistry. Unlike pulsed lasers, and regardless of the pulsed nature of synchrotron radiation, no chemistry has been examined while taking full advantage of the pulsed nature of synchrotron light. The chief hurdle to overcome for general utilization of pulsed synchrotron radiation is the inability of the experimentalist to control the radiation bunches that strike the sample under investigation. The repetition rate for large synchrotrons is 300,000 bunches per second or faster, i.e., the minimum time between synchrotron pulses is less than 3.5 μs. For example, the Advanced Photon Source (APS), a new synchrotron to be completed at Argonne National Laboratory by 1996, will primarily operate such that the time interval between bunches is about 180 ns. The shorter this interbunch spacing, the more severe the problem of exploring the time domain.

Figure 2:
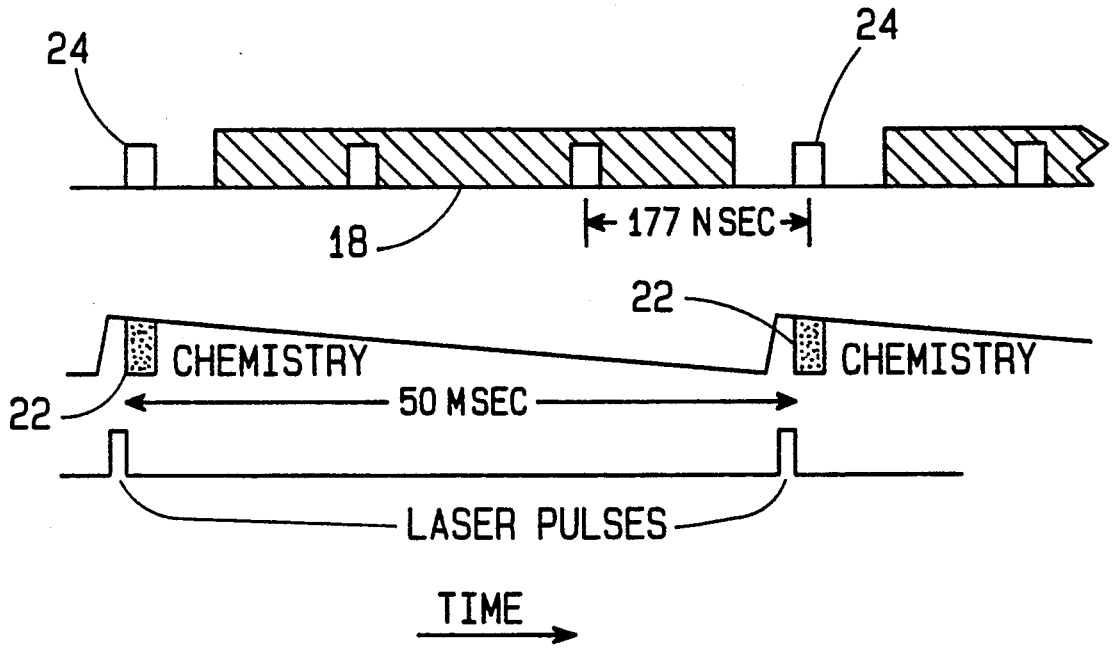
FIG. 2 shows a schematic representation of the timing sequence of the synchrotron shutter in which laser pulses are synchronized with the synchrotron pulses to excite the chemistry of a probed structure.

The repetition rate of most pulsed lasers used in time-domain optical spectroscopy ranges from 10 to 1000 per second. The requirement of such low repetition rates is controlled by the chemistry of the sample. Moreover, a single pulse of radiation is usually not sufficient to provide enough signal-to-noise for a complete experiment. Instead, the results of several hundreds or thousands of probe pulses must be averaged, requiring the sample to be in the same state each time the monitoring pulse strikes the object of study. This situation requires systems with reversible chemistry or physics (or, in some situations, the use of "flowing" samples). In an advanced version of the experiment, an intense laser "pump pulse" is used to create an excited state from a relaxed ground state. An additional "probe pulse" then follows in order to examine the nature of the excited state of the sample. Referring to FIG. 2, in determining structural features of the excited state, a synchrotron x-ray "probe pulse" 24 must examine the sample 22. The x-ray pulse may be part of a time-domain EXAFS or XANES experiment. The important point is that before the occurrence of a second x-ray pulse, the sample must return to its initial relaxed ground state. Otherwise, the second x-ray probes a different condition of the system than the previous X-ray bunch, thus invalidating any data-averaging scheme.

Photosynthesis provides a situation to illustrate this dilemma. Although the first laser pulse to strike a reaction center induces an electron transfer in 2.8 ps, relaxation back to the ground state requires approximately 15 ns for the main reaction of the singlet manifold and about 100 μs for the accompanying secondary photochemistry of the triplet manifold. Because no synchrotron facility provides the means to control the time interval between single radiation bunches, photosynthesis and other artificial systems cannot be explored in the time domain using single-bunch synchrotron radiation. Unfortunately, systems nost interesting in chemistry have relaxation rates considerably longer than 3.5 μs, the typical maximum time interval between synchrotron pulses. Also, as assumed in FIG. 2, the standard method of operation is a multibunch mode such that the interpulse interval is considerably shorter than 3.5 μs. Consequently, the relaxation and recovery rate of the chemistry must be even faster.

The present invention appropriately "shutters" synchrotron radiation of energies up to 20 Kev and thereby provides a single bunch of synchrotron radiation on demand. Moreover, working in the multiple-bunch mode of the synchrotron operation insures that sufficient experimental time can be devoted to this new class of synchrotron research.

This invention is primarily designed for the APS at Argonne National Laboratory. The dimensional size of the x-ray beam to be chopped is assumed to be 0.5 mm. The fact that one must work in the 20-bunch mode in order to insure allocation of significant user time is considered in the shutter design. In the 20-bunch mode of the APS, an x-ray pulse will occur every 177 ns, requiring each edge of a conventional two-blade "shutter" to travel at least 0.25 mm in 177 ns. In other words, the blades would have to spin approximately four times faster than the speed of sound. Even though rotational speeds up to 1,200,000 rpm (20,000 Hz) are possible, most devices do not exceed the speed of sound in air (or in a gas such as helium). Although supersonic turbine design is known, the present scheme avoids this approach.

After resolving the major technical issue of performing such experiments, a second, equally important question that arises is associated with the range of realistic problems that can be explored by time-domain X-ray techniques. Of the many different utilizations of X-ray radiation, the validity issue is considered the most severe for time-domain X-ray structure determinations at atomic resolution using single crystals. This problem has been treated in some detail in the literature, primarily by Moffat and Helliwell, *Topics in Current Chemistry* 151, pp 61–74, and Mills et al., Science 1984, pp 811–13. Generally speaking, the conclusion of these investigators is that such experiments should be possible if the proper single-crystal samples are used. Thus, no significant theoretical or experimental reasons exist to prevent the ultimate success of the most difficult of these time-domain X-ray experiments, namely time-dependent single-crystal structure determinations.

EXAMPLE

As an initial step toward solving transient molecular structure, EXAFS has been conducted on some model compounds with the currently available synchrotron source, NSLS (National Synchrotron Light Source), at Brookhaven National Laboratory. Conventional EXAFS detects distances between a metal atom and its surrounding atoms via the interaction of ejected photoelectron waves from the central atom with back-scattered waves from neighboring atoms. This technique is capable of determining the distance between the central metal atom and the nearest neighbor atoms with an accuracy of 0.01 Å. EXAFS has the following advantages over X-ray diffraction for solving the structural changes due to photoexcitation: 1) it can be applied to samples with various forms, e.g., solid, solution, and amorphous materials; 2) it focuses on local structural changes, thus relatively fewer parameters and data points are required; 3) it has higher resolution in determining local atom-atom distance than X-ray diffraction in large protein molecules.

One model system that appears most suitable to a time domain EXAFS study is the photoexcited triplet state of zinc porphyrins. These triplet states are long-lived (milliseconds at 77K) and are believed to exhibit bond-length changes ranging from 0.01 to 0.02 Å when going from the ground state to excited state. Calculations have been performed that optimize geometry. The zinc-nitrogen bond lengths for the ground state and the first excited triplet state are provided in Table 1.

TABLE I

| Bond | Calculated zinc-nitrogen lengths in pentacoordinate ZnTPP.pyridine: Length, Å: Triplet State | Length, Å: Ground State | Difference, Å: Triplet-Ground State |
|---|---|---|---|
| TPP | 2.0090 | 2.0099 | −0.0009 |
| TPP | 2.0260 | 2.0279 | −0.0019 |
| TPP | 2.0083 | 2.0136 | −0.0103 |
| TPP | 2.0160 | 2.0239 | −0.0079 |
| Pyridine | 1.9502 | 1.8715 | −0.0213 |

Figure 3B:
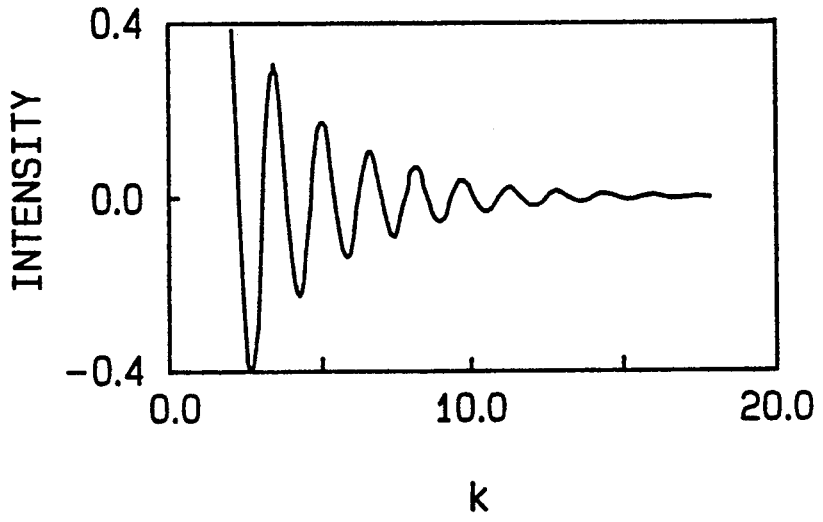
FIGS. 3A and 3B shows simulated EXAFS spectra of the ground and excited states of a zinc porphyrin, respectively.
Figure 3A:
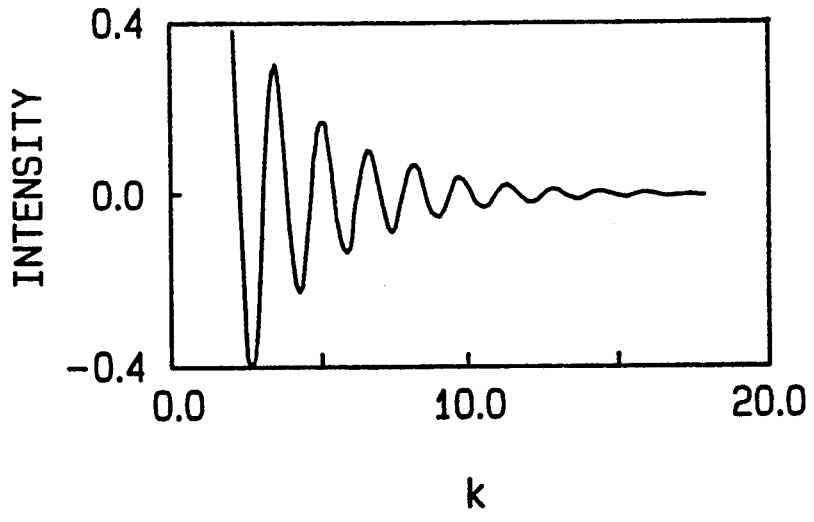
Figure 4:
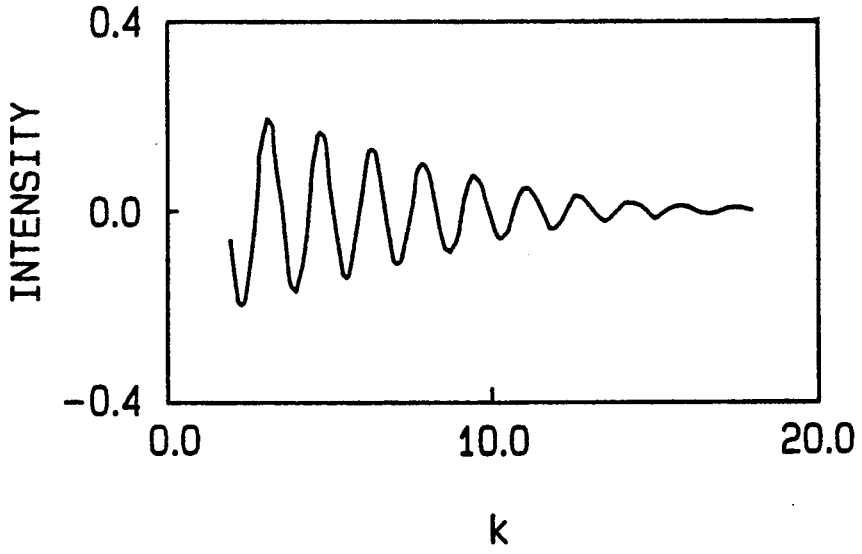
FIG. 4 shows the difference spectrum of the simulated triplet excited state and ground state spectra of FIG. 3.

Using this theoretical data EXAFS spectra have been simulated as shown in FIGS. 3 and 4. FIG. 3 shows the EXAFS of the ground state and excited triplet state, and FIG. 4 gives the EXAFS of the triplet state-ground state difference. The difference signal is approximately 10% of the total signal and should be readily detectable.

Under the above conditions, an experiment with lock-in amplifier detection has been designed to search for the bond-length difference between the ground and excited state ZnTPP (zinc tetra-phenylporphyrin) and ZnOEP (zinc octa-ethylporphyrin). A light source for the excitation is modulated at an appropriate repetition rate, according to the triplet lifetime of the model compounds. This modulation is used as a reference frequency of the lock-in detection. Thus, the signal detected will be the difference of the EXAFS spectra with and without excitation. Therefore, any positive results will provide direct evidence for a structural change between the ground and excited states. This experiment should provide the first indication that a bond-length change in the excited state is detectable with EXAFS.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiment was chosen and described to best explain the principles of the invention and its practical application and thereby enable others skilled in the art to best utilize the invention in various embodiments and with various modifications as are suited to the particular use contemplated. It is intended that the scope of the invention be defined by the claims appended hereto.

The embodiments of the invention in which exclusive property rights or privileges are claims are defined as follows:

1. An apparatus for selecting a single synchrotron pulse from a sequence of pulses from a synchrotron source comprising:

a rotatable spindle having multiple faces of a reflective surface placed in the path of the pulses;

a shutter spaced from the spindle and synchrotron source at a location to receive pulses reflected from the spindle, the shutter including a gap of substantially less width than the spacing between the spindle and shutter;

the spacing of the shutter from the spindle, the rotational speed of the spindle, and the width of the gap in the shutter, all being selected so that the reflected light off the spindle moves at a speed to transmit only a single pulse of radiation through the gap in the shutter.

2. The apparatus of claim 1 wherein the rotational frequency of the spindle is slaved to the synchrotron pulse frequency.

3. The apparatus of claim 2 wherein the spindle is eight-sided.

4. The apparatus of claim 3 wherein the sides of the spindle are mirrored.

5. The apparatus of claim 4 wherein the spindle has a frequency of rotation f, the shutter is spaced from the spindle by a radius r, and the speed s of the pulses arriving at the shutter is given by:

$$s=4\times\pi\times r\times f.$$

* * * * *